US011445813B1

(12) United States Patent
Dresser

(10) Patent No.: US 11,445,813 B1
(45) Date of Patent: Sep. 20, 2022

(54) PAINT BRUSH WRAPPER

(71) Applicant: Miriam Dresser, Evanston, IL (US)

(72) Inventor: Miriam Dresser, Evanston, IL (US)

( * ) Notice: Subject to any disclaimer, the term of this patent is extended or adjusted under 35 U.S.C. 154(b) by 0 days.

(21) Appl. No.: 17/341,971

(22) Filed: Jun. 8, 2021

(51) Int. Cl.
*B44D 3/04* (2006.01)
*A46B 17/04* (2006.01)
*A46B 17/00* (2006.01)

(52) U.S. Cl.
CPC ..... *A46B 17/04* (2013.01); *B44D 3/04* (2013.01); *A46B 17/00* (2013.01); *A46B 2200/202* (2013.01)

(58) Field of Classification Search
CPC ..... A46B 17/00; A46B 17/04; B44D 3/04; B65D 75/02
See application file for complete search history.

(56) References Cited

U.S. PATENT DOCUMENTS 2,485,068 A * 10/1949 Santana ..... A46B 17/04 206/361
2,506,954 A * 5/1950 First ..... B65D 75/02 206/362.4
3,000,491 A * 9/1961 McIntosh ..... B65D 75/02 206/361
3,167,178 A * 1/1965 Saunders ..... B65D 75/02 206/361
4,967,903 A * 11/1990 Kettle ..... B44D 3/006 206/209
5,465,453 A * 11/1995 Landmeier ..... A46B 17/04 15/247
7,111,354 B2 * 9/2006 Nennig ..... A46B 17/04 15/247
2007/0062823 A1 * 3/2007 Anderson ..... B44D 3/125 206/1.8

* cited by examiner

*Primary Examiner* — Michael D Jennings
(74) *Attorney, Agent, or Firm* — Paschall & Associates, LLC; Mark Goldberg

(57) ABSTRACT

A wrapper for a paint brush is provided which is intended for use after the brush has been used. In most instances the brush has been cleaned with water or other solvents and then placed in the paint brush wrapper so that the bristles portion of the paint brush are covered. A fastener such as a cord is used to hold the wrapper in place. The wrapper is made of an air permeable material to allow for the brush to dry and then be reused. The wrapper extends the useful life of the paint brush.

12 Claims, 5 Drawing Sheets

PAINT BRUSH WRAPPER

This relates to a device for protecting paint brushes and in particular relates to their protection after being cleaned.

A paintbrush is a brush used to apply paint in either an artistic setting or by a tradesperson or amateur using the paintbrush to apply paint to a substrate surface such as walls or other surfaces. A paintbrush is usually made by clamping bristles to a handle with a ferrule. The bristles transfer paint from a paint container such as a can to a substrate surface. Brushes are designed to apply an even coat of paint to a surface. The paint brush handle may be of a specialized design such as a gourd handle having an ergonomic design that reduces stress on the wrist and hand while painting or a with a short handle that provides greater precision when painting small spaces such as corners, trims and detail areas. Other paint brush configurations include brushes having a flat beavertail handle with a shape that is rounded and slightly flattened to fit perfectly into the palm of the hand while painting; a square handle with beveled corners that is featured mainly in trim or sash brushes and is comfortable to hold when painting; a rat tail handle that is longer and thinner than the standard paint brush handle making it easy to hold to give greater control or a long handle that is rounded and thin and is easy to hold like a pencil giving great control and precision when cutting in and painting difficult spaces. There are numerous brush sizes, referring to the width of the brush head, that include metric sizes of 10-100 mm generally available at widths of multiples of 10 mm and US customary sizes that range from as narrow as ⅛ inches but most often between 1-4 inches with the most frequent sized brushes sold in the US having a width of 2½ in. These brush sizes, for the purposes of the present invention, may be referred to as small (1 in. or less), medium (2-3 in.) and large (over 3 in.) in width. The brushes may have any of the following shapes such as angled shapes to allow for painting edges with the bristle length viewed from the wide face of the brush uniformly decreasing from one end of the brush to the other end, flat, for painting flat surfaces with the bristle length viewed from the wide face of the brush that does not change; tapered which improves control, where the bristle length viewed from the narrow face of the brush is longer in the center and tapers towards the edges and striker having a large round cylindrical shape for exterior painting of difficult areas. Bristles may be made from a natural or synthetic material. If the bristle filaments are synthetic, they may typically be made of polyester, nylon or a blend of nylon and polyester. Filaments may be hollow or solid and either tapered or not tapered. Brushes with tapered filaments may provide a smoother finish. Synthetic filaments generally last longer than natural bristles. Natural bristles are usually preferred for oil-based paints and varnishes, while synthetic brushes are considered to be better for water-based paints since the bristles do not expand when wetted with paint. The quality of a brush is based on several factors: filament retention, paint pickup, steadiness of paint release, brush marks, drag and precision painting. A chiseled brush permits the painter to cut into tighter corners and paint more precisely. Brush handles may be made of wood or plastic while ferrules are usually metal (such as nickel-plated steel). In all but the least costly of these paint brushes, the user wishes to be able to clean and reuse the brushes such as by washing in soap and water with water soluble paints or in turpentine or paint thinners in the case of oil-based paints. Both professional painters as well as amateur painters may have a significant investment in their paint brushes that may range in cost from $15-40 when purchased new. It is highly desirable that the paint brushes maintain their original condition after each use and cleaning in order to maintain their usefulness for their intended purpose. In the past, many painters placed their brushes on their equipment or an empty surface. Unfortunately, this can lead to the bristles losing their straight configuration. The brushes could also be placed on a newspaper or be stuck to a drop cloth with issues such as adhering to the surface as it dries. It would be desirable to have a way to better preserve a paint brush.

SUMMARY OF THE INVENTION

A wrapper for a paint brush has been developed for use with paint brushes that have a set of bristles at one end of the brush. The wrapper is a flexible piece of material adapted to confirm to an outer configuration of the set of bristles. The paint brush to which the wrapper is used is usually a cleaned paint brush, although in some instances the wrapper may be placed around or applied to the paint brush before cleaning the wet paint from it provided that prompt cleaning of the paint brush is to follow. Often the wrapper may be placed upon the cleaned paint brush that is still wet from water or other solvent such as an oil-based solvent that was used in its cleaning. In some embodiments, the wrapper is made from a thick paper or paper-like material that is at least somewhat permeable to water or other solvents used in the cleaning of the paint brush so that the brush bristles may dry while the wrapper is encompassing the bristles. While there are several possible configurations for the wrapper, an efficient configuration is that the wrapper starts out as an elliptical or oval piece of a material that has a centered opening through which the brush handle may be inserted. The opening may be made during the manufacturing process for the wrapper or may be added later by the painter or other individual who is placing the wrapper on the paint brush. There also may be an indentation or other indication on the wrapper such as markings so that the person is guided in making the opening. The wrapper may have a centered opening configured so that a handle of the brush, which is on the other end from the set of bristles, passes through the opening. This opening may be cut or otherwise made in the manufacturing process or it may be made by the user who can adjust the size of the opening as needed to allow the paint brush handle to fit through the opening. In one embodiment, the wrapper is from a thick paper material comprising about 50-90 wt % polyester and about 10-50 wt % cellulose, preferably the thick paper material comprises about 60-80 wt % polyester and about 20-40 wt % cellulose and most preferably about 70 wt % polyester and about 30 wt % cellulose. In one design, the oval is located and configured so that said handle enters about two inches from a bottom of said oval. In any case, the handle is located through an opening that allows for the bristles to be adequately covered. The wrapper may have a bottom portion of the oval that is folded up and side portions of the oval that are folded toward the brush and attached by adhesive to an adjacent portion of the oval so that the sides are on top of said bristles and a ferule configured to hold said bristles to the brush. The adhesive may be a glue. A top portion of the oval may be held in place to the paint brush by a fastening means such as an elastic band, flexible string or cord or a hook and loop fastener. In a preferred embodiment, the wrapper is folded as explained herein and held in place by an elastic cord that may be adjustable to hold the wrapper securely on the paint brush. In these instances, the material is not glued in place so that the wrapper may be reused for use with a different brush or refolded to be used with a different sized brush. Typically, the wrapper is an ellipse or oval that has a size configured to fit the width of a brush. There can be several sizes of wrappers that are made that will accommodate the width of most paint brushes.

In another embodiment of the invention is provided a method of fitting a brush wrapper to fit a paint brush comprising selecting a section of a thick material which is preferably an oval shaped flat section of the thick material where the material has a surface area sufficiently large enough to cover all surfaces of the set of bristles. An opening in the brush wrapper is configured to allow a handle of said paint brush to fit through the opening. In the method of fitting a brush wrapper, a bottom portion of the material is folded towards the paint brush. Then two side portions of the oval are folded towards the paint brush, and a top portion of the oval is folded so as to totally enclose the bristles of the paint brush. The paint brush wrapper is then fastened in place by an appropriate fastener such as an elastic band, a flexible cord, or a hook and loop fastener. In the case of the flexible cord or elastic band it may easily be adjusted or removed. The wrapper preferably comprises a non-woven liner material.

DESCRIPTION

Figure 1:
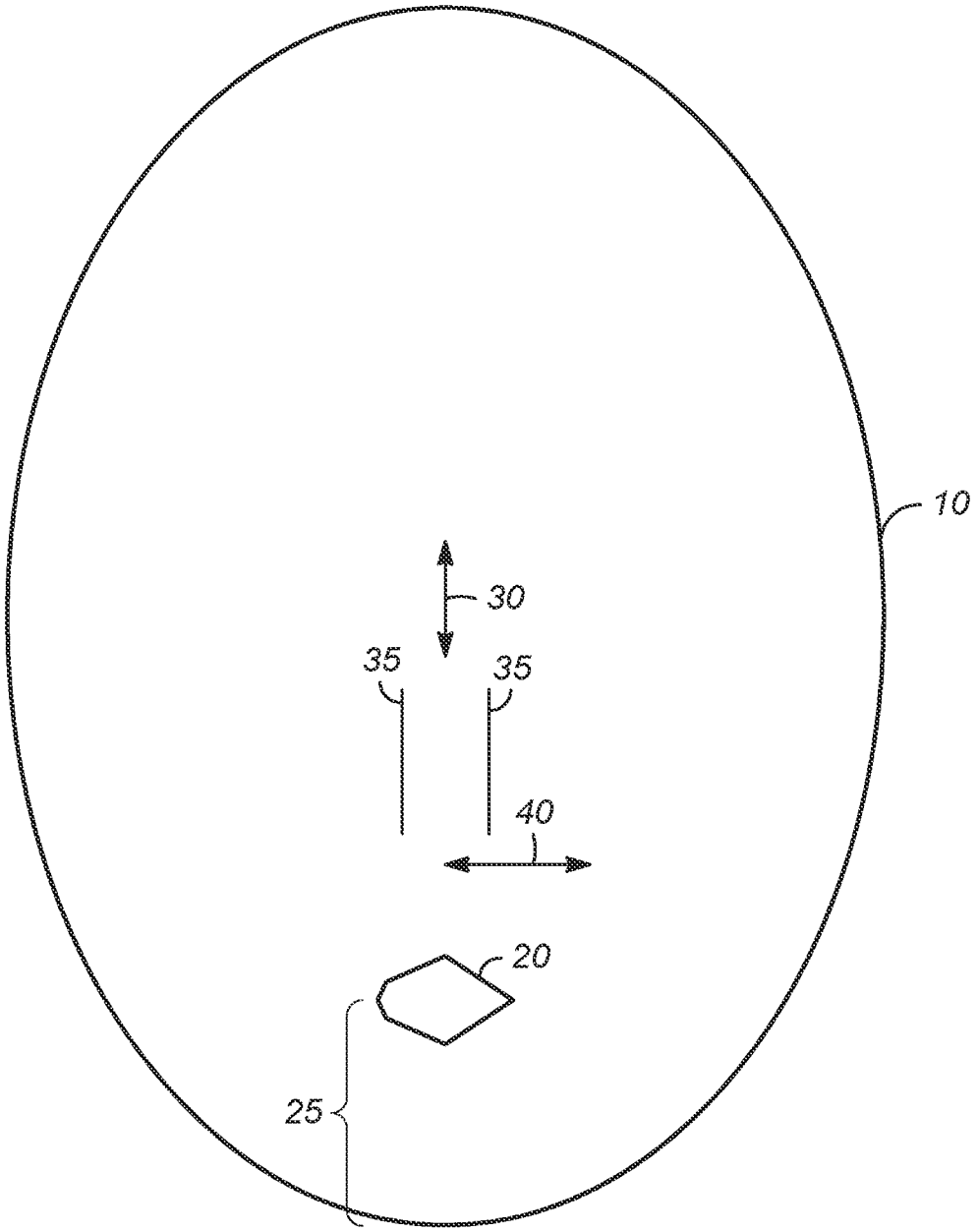
FIG. 1 shows an oval of material used in the invention.

A device and a method of using the device has been developed to protect a clean paint brush to preserve the shape of the paint brush's bristles until dry. The device is a flexible, yet somewhat stiff material that allows breathability, permitting the brush to dry relatively quickly, especially compared to the cardboard packaging in which a paint brush is sold. An example of a material that may be used is the nonwoven liner typically used with wallpaper. The material may be a blend of a polyester and a cellulose, such as from 50-90 wt % polyester and 10-50 wt % cellulose, preferably about 60-80 wt % polyester and 20-40 wt % cellulose and more preferably about 70 wt % polyester and 30 wt % cellulose. The material has a thickness of about 400-900 microns, preferably from about 400-800 microns and most preferably about 500-750 microns. Usually the device which is described herein as a paint brush wrapper, is used after a paint brush has been cleaned and is drying off from water or solvent that was used in its cleaning. One material that was found to be particular advantageous is manufactured by Ahlstrom Nonwovens LLC of Windsor Locks, Conn. This material is a 3.7 oz/yd$^2$ wet laid nonwoven, that is composed of a mixture of synthetic and cellulose fibers that are treated with a chemical binder. The properties, which are mainly important in determining the type of material to use is that it has sufficient stiffness yet is flexible enough to fold into position include a basis weight of 126 g/m$^2$, dry grab tensile strength MD of 40 grams, dry grab tensile strength CD of 24 grams and thickness of 645 microns. This material should be selected so that it is sufficiently porous to allow enough air flow through the material to allow gradual drying when the brush has put into the wrapper before it has been dried.

The material is thick enough to retain stiffness when it is in use yet easily folded into place. In one example the section of material is an approximate oval or elliptical shape in order to be folded in the configuration found to best serve the desired purpose of protecting the paint brush. In one example, the elliptical or oval shape is 8×12.5 inches, but smaller ovals may be used for smaller paint brushes as well as larger ovals to fit a large paint brush. In this particular example, there is a centered hole to insert the handle of the paint brush with the hole or opening about 2 inches from the bottom. The hole or opening may be of a different size depending upon the diameter of the paint brush handle. The user of the paint brush holder may enlarge the hole or opening in order to allow a particular paint brush to fit in. Also, the material may have scoring imprinted that allow the user to create or enlarge the opening for a particular brush. After the bottom is folded up, the sides are folded in and may be glued in place. However, in instances where the user may reuse the wrapper for different sizes of brushes where the oval shaped material is folded in place and then a single fastener holds it in place. In this instance, the top of the oval then folds down and is fastened in place by a fastening means. One possible fastener may be a strap of a hook and loop material such as a strap having a Velcro surface is used to hold the top of the oval in place. Another type of fastener may be a string or elastic band that can be secured to some post or structure to keep the paint brush wrapper sufficiently in place to hold the paint brush in position. Yet another type of fastener that has been found effective is an elastic cord held in place by a cord stop. The elastic cord may be about 2 mm to 3 mm in thickness and long enough so that the cord stop is snug enough against the wrapper to hold the wrapper in place. Other fasteners may be used as long as they are adjustable and maintain the folded material around the bristles of the brush.

The flexible, yet somewhat still material that is used allows for breathability, permitting the brush to dry relatively quickly, especially compared to the cardboard material that paint brushes are typically packaged in. The paint brush wrapper is preferably fitted loosely enough to the paint brush to allow air flow to assist in drying, yet secure enough to remain in place.

Figure 5:
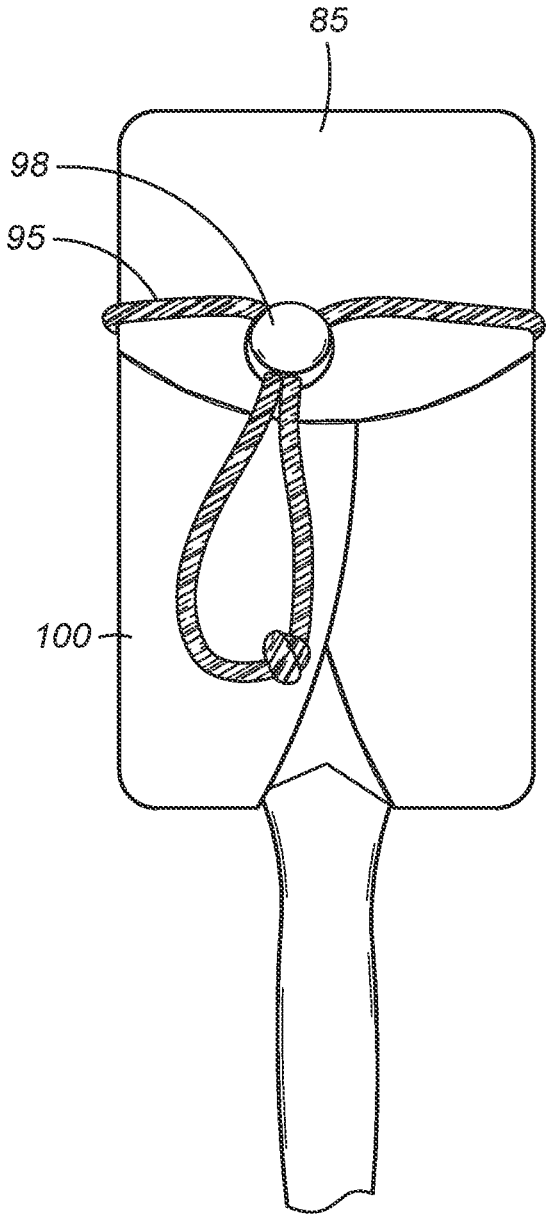
FIG. 5 shows a paint brush with the wrapper held in place with a flexible cord.

The invention is better explained with reference to the Figures. FIG. 1 shows an oval that is about 8.5×12" in configuration with an opening 20 for insertion of a paint brush that in this example is about 2 inches from the bottom edge this space is signified as distance 25. The oval has a length 30 and a width 40. There are slits 35 through which an elastic band may pass to hold the paint brush wrapper in place as shown in FIG. 5. There may be markings on the oval for guidance in where to fold the material to enclose the brush bristles in place.

Figure 2:
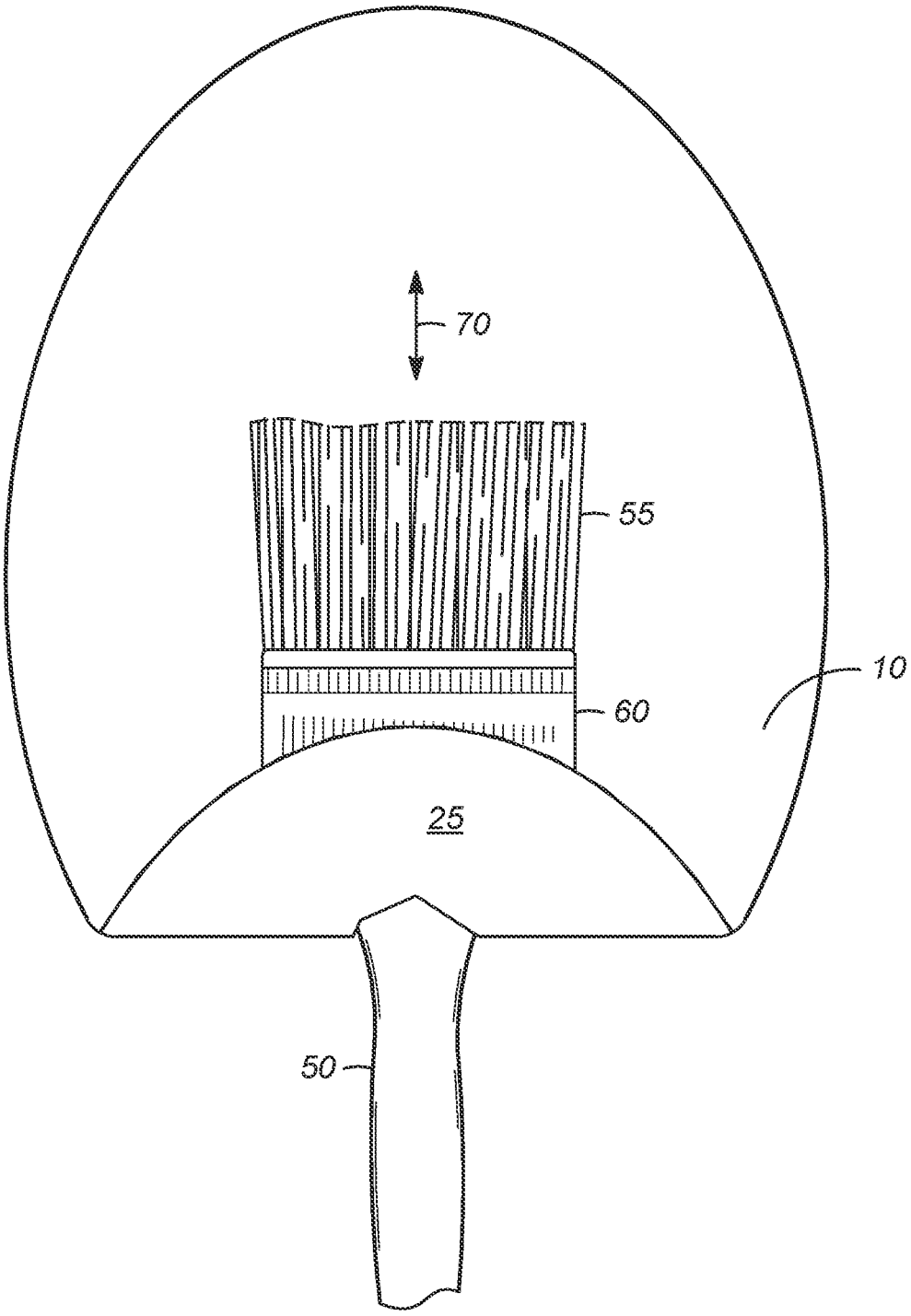
FIG. 2 shows a paint brush in place in the oval of material with one fold to secure it in place.
Figure 3:
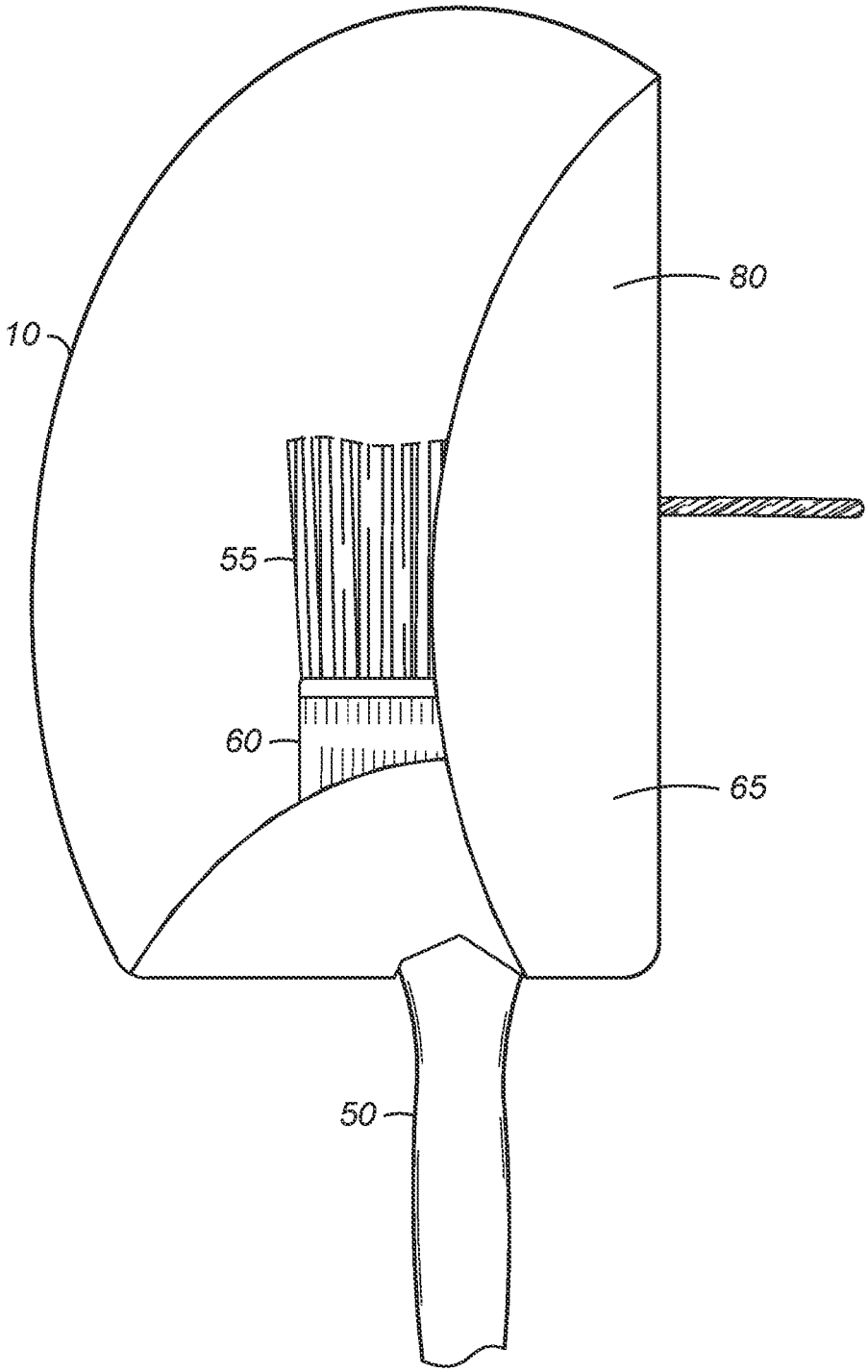
FIG. 3 shows a paint brush with the oval folded in two directions.
Figure 4:
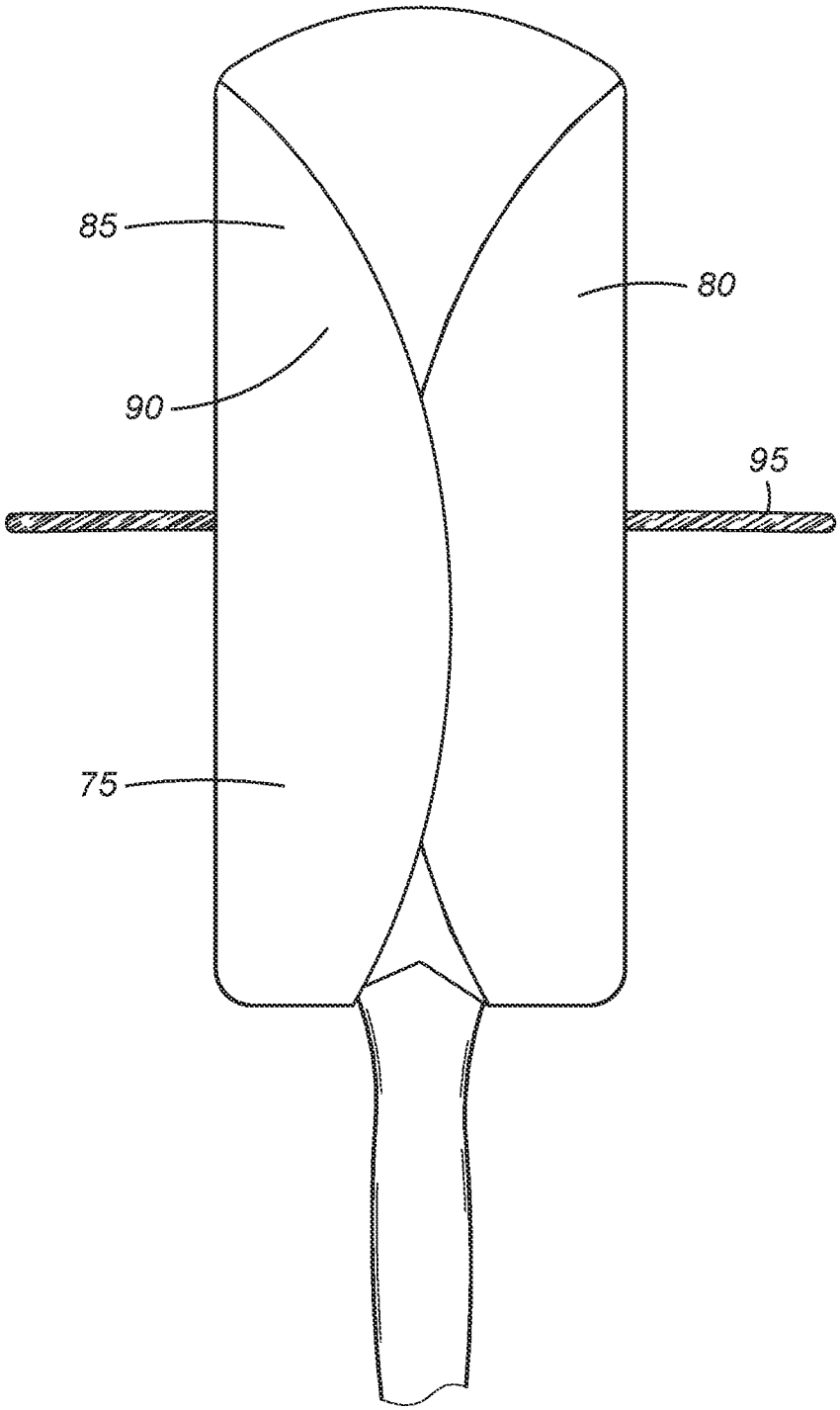
FIG. 4 shows a paint brush with the oval folded in 3 directions.

FIG. 2 shows material oval 10 with a brush having a set of bristles 55 and a ferrule 60 holding the bristles in place. Handle 50 extends below opening 20. A bottom portion 25 of the oral is folded up and a top portion 70. In FIG. 3 is shown a right-hand portion 65 folded over and a top right portion 80. Then in FIG. 4 the left side is shown as having a bottom portion 75 and a top portion 85 with a crease 90 along which the final fold is accomplished to produce the completely wrapped brush 100 with top portion 85 showing along with elastic band 95. There may be markings on the material that show where these folds are to go with multiple markings to allow for use with different sized brushes. FIG. 5 shows the wrapped brush 100 totally enclosing the upper portion of the brush with a top portion 85 and an elastic band 95 having a cord stop 98 which allows the same length of elastic band to be used for brushes of different widths.

The invention claimed is:

1. A paint device comprising: a wrapper and a paint brush, said wrapper comprising a flexible piece of material wherein said wrapper is adapted to conform to an outer configuration of a set of bristles of said paint brush wherein said wrapper is porous to air, wherein the flexible piece of material is approximately oval in an outer perimeter, with a centered opening configured so that a handle at an opposite end of said paint brush from said set of bristles passes through said opening, a bottom portion of said oval is folded up, side portions of said oval are folded toward said brush and a top portion are held in place by a fastener.

2. The wrapper of claim 1 wherein said set of bristles within said wrapper further comprises a solvent on said bristles.

3. The wrapper of claim 2 wherein said solvent is water or an oil-based solvent.

4. The wrapper of claim 1 wherein said wrapper comprises a thick paper material having a thickness of about 500 to 800 microns.

5. The wrapper of claim 4 wherein said thick paper material comprises about 50-90 wt % polyester and about 10-50 wt % cellulose.

6. The wrapper of claim 4 wherein said thick paper material comprises about 60-80 wt % polyester and about 20-40 wt % cellulose.

7. The wrapper of claim 4 wherein said thick paper material comprises about 70 wt % polyester and about 30 wt % cellulose.

8. The wrapper of claim 1, wherein said oval is configured so that said handle enters about two inches from a bottom of said oval.

9. The wrapper of claim 1, wherein said fastener is an elastic band, a flexible strap or a hook and loop containing strap.

10. The wrapper of claim 1, wherein said fastening means fastener comprises an elastic band held in place by a cord stop.

11. The wrapper of claim 1, wherein said oval has a size configured to fit a width of said brush.

12. The wrapper of claim 1 having a thickness of about 500 to 800 microns.

* * * * *